US006685346B2

(12) United States Patent
Wu

(10) Patent No.: US 6,685,346 B2
(45) Date of Patent: Feb. 3, 2004

(54) DO-IT-YOURSELF LAMP ROD

(76) Inventor: Wen-Chang Wu, Taipei (TW)

( * ) Notice: Subject to any disclaimer, the term of this patent is extended or adjusted under 35 U.S.C. 154(b) by 14 days.

(21) Appl. No.: 10/074,436

(22) Filed: Feb. 13, 2002

(65) Prior Publication Data

US 2003/0151923 A1 Aug. 14, 2003

(51) Int. Cl.[7] ..... F21S 8/06
(52) U.S. Cl. ..... 362/405; 362/442; 439/551
(58) Field of Search ..... 362/405, 442, 362/457, 458; 439/550, 551, 564; 248/342, 906

(56) References Cited

U.S. PATENT DOCUMENTS 1,129,982 A * 3/1915 Hotchkin ..... 362/405
3,529,278 A * 9/1970 Bishop ..... 439/551
3,613,048 A * 10/1971 Brundza ..... 439/275
3,876,277 A * 4/1975 Colwell ..... 439/551
6,428,354 B1 * 8/2002 Meyer et al. ..... 439/551
6,517,223 B2 * 2/2003 Hsu ..... 362/405

* cited by examiner

*Primary Examiner*—Alan Cariaso
*Assistant Examiner*—Ismael Negron

(57) ABSTRACT

A do-it-yourself lamp rod is formed by a retaining seat and an inserting rod inserting into the retaining seat. The retaining seat is locked to the inner side of a wire connecting box, and a rectangular inserted hole of the retaining seat has a positioning block therein. Thereby, an inserted hole and the positioning block can be engaged. A limiting ring is locked to the inserting portion of the retaining seat. As the limiting ring is released, then the inserting rod can be pulled out. The wire connecting box and inserting rod can be detached so as to reduce the volume for storing, transferring and packaging. Thereby, the user need only insert the inserting rod into the wire connecting box and then lock the limiting ring and thus the assembly of the present invention is completed. Therefore, the present invention can be assembled by users.

4 Claims, 5 Drawing Sheets

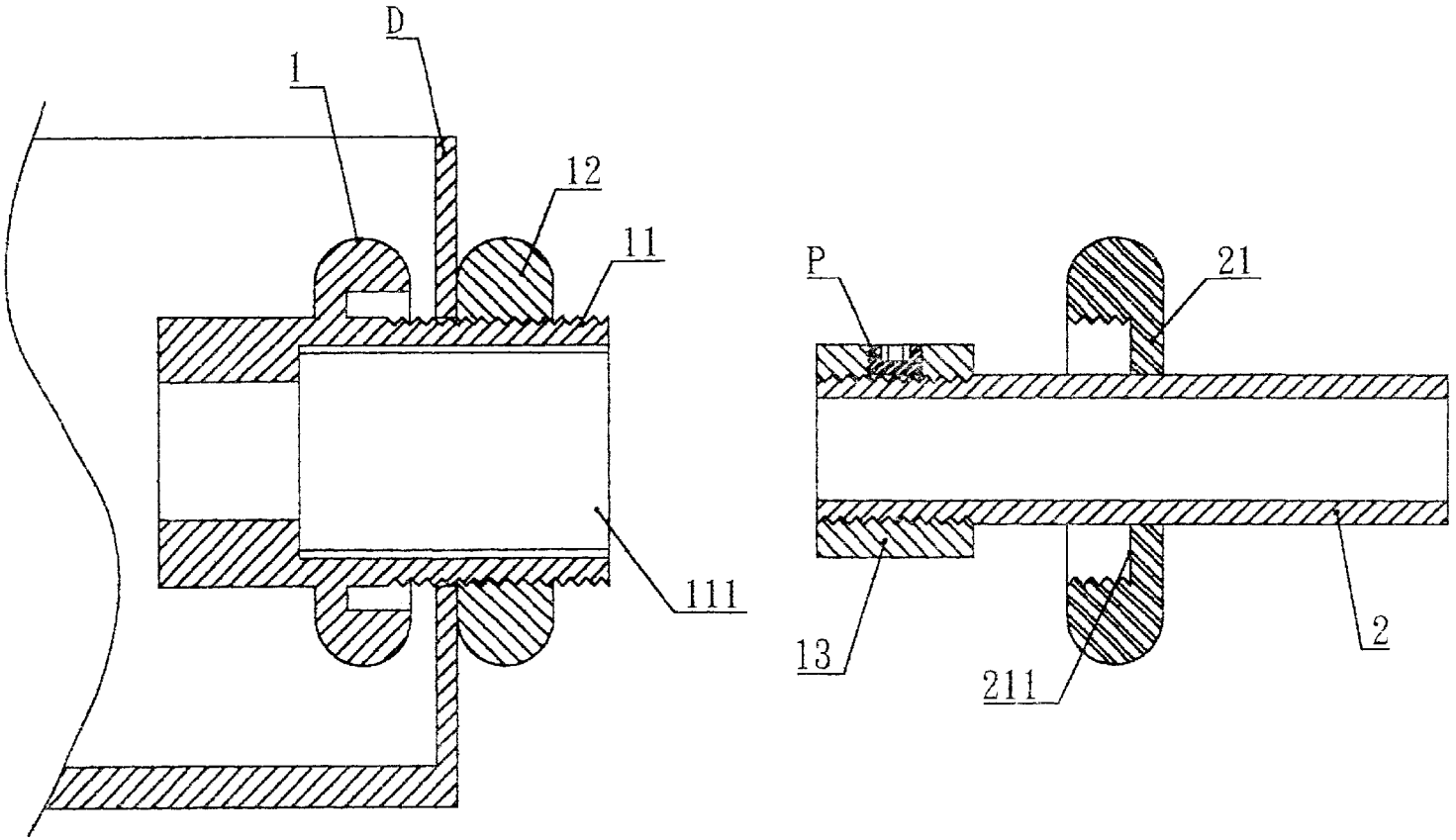
FIG3-A

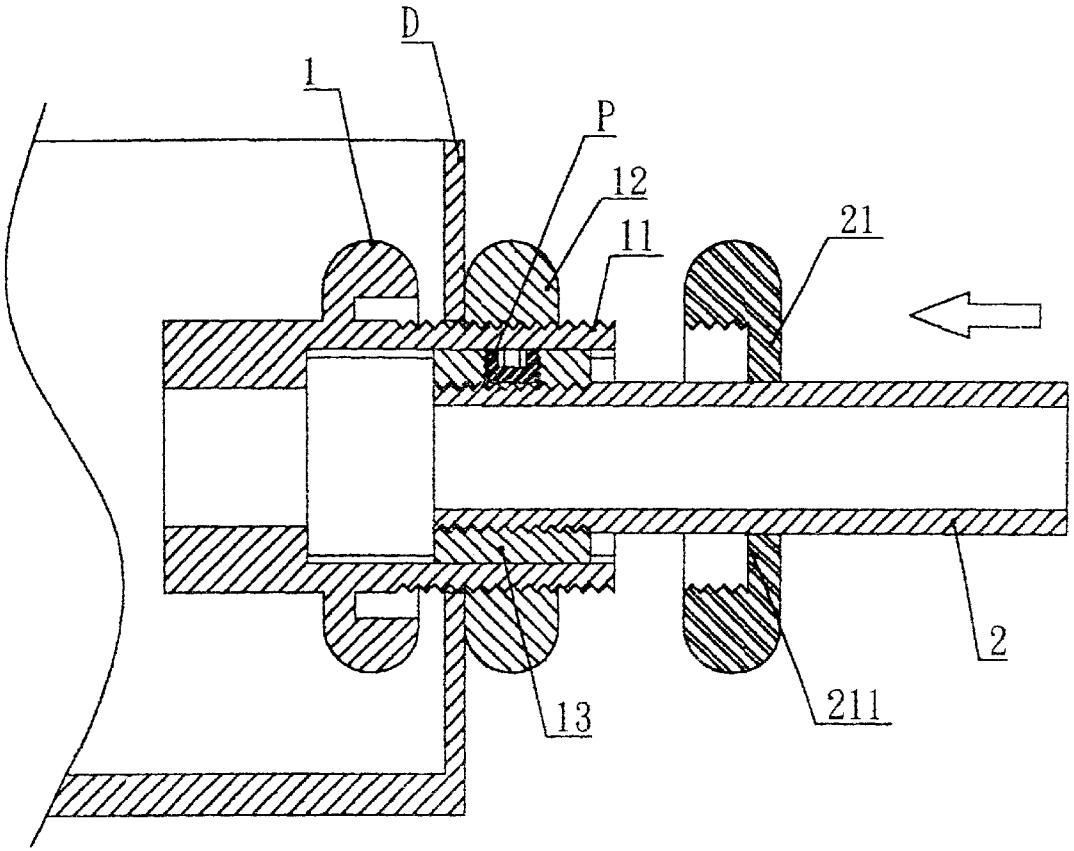
FIG3-B

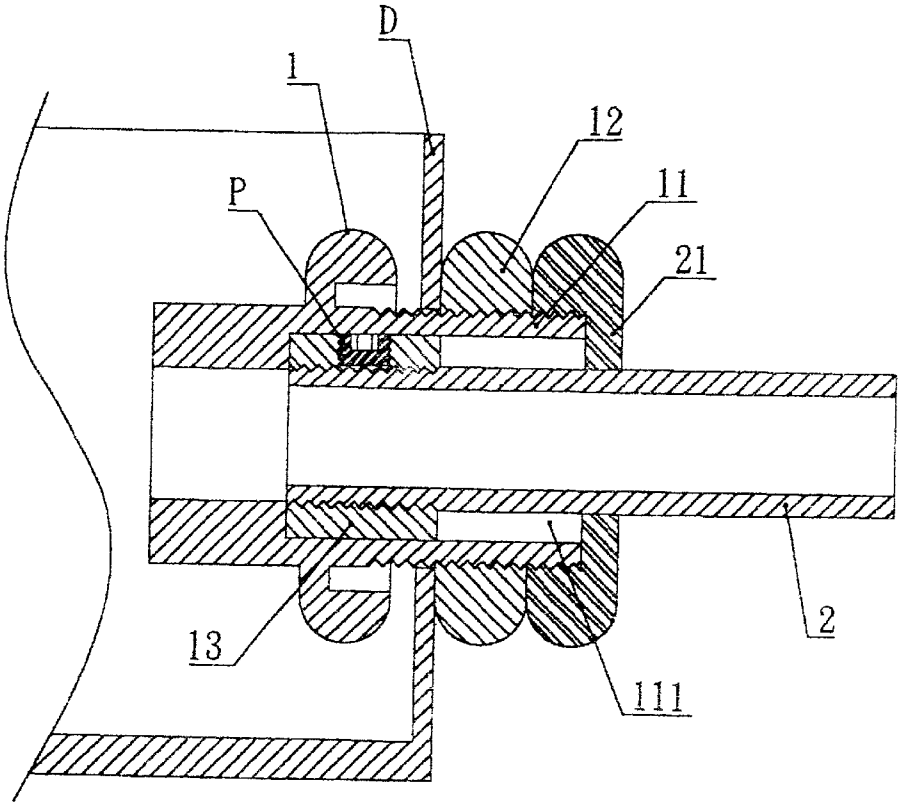
FIG3-C

DO-IT-YOURSELF LAMP ROD

FIELD OF THE INVENTION

The present invention relates to lamp device, and particularly to a lamp rod which can be assembled by users himself (or herself)

BACKGROUND OF THE INVENTION

Prior wire connection devices of lamps, such as wall lamps, stand type lamps, and ceiling lamps, use studs and nuts to lock the components. In assembly, not only the user is easy to be harmed, but also other locking tools (such as spanners, openers, etc.) are necessary. Moreover, in assembly, electric wires are easy to expose out and some dangers are induced. Thereby, the prior art is not suitable to be assembled by the user himself (or herself). In general, since in the prior art design, the wire is possibly exposed out if the assembly work is performed by the user, the manufacturer assembles the device in advance, namely, the wire box is assembled by inserting rods in the manufacturing process. However, this will induce that a large space is required for transferring and storing and thus cost is increased.

SUMMARY OF THE INVENTION

Accordingly, the primary object of the present invention is to provide a do-it-yourself lamp rod which is formed by a retaining seat at a lateral side of a wire connecting box and an inserting rod inserting into the retaining seat. The retaining seat is locked to the inner side of a wire connecting box, and a rectangular inserted hole of the retaining seat has a positioning block therein. Thereby, an inserted hole and the positioning block can be screwed engaged. A limiting ring is locked to the inserting portion of the retaining seat so that the positioning block and the inserting rod are firmly secured to a wire connecting box.

Another object of the present invention is to provide a do-it-yourself lamp rod, wherein a limiting ring is released, then the inserting rod can be pulled out. Thus it can be packaged and stored, the wire connecting box and inserting rod can be detached so as to reduce the volume for storing, transferring and packaging. Since the wire connecting box and inserting rod can be detached for reducing the material for transferring and storing, and the retaining seat inserted by the inserting rod is installed to the wire connecting box in advance. Thereby, the user needs only insert the inserting rod into the wire connecting box and then lock the limiting ring and thus the assembly of the present invention is completed. No other stud, or tools are necessary. Therefore, the present invention can be assembled by users.

The various objects and advantages of the present invention will be more readily understood from the following detailed description when read in conjunction with the appended drawing.

BRIEF DESCRIPTION OF THE DRAWINGS

FIG. 3-A is a plane cross sectional view of the present invention before the inserting rod is inserted.

FIG. 3-B is a plane cross sectional view of the present invention where the inserting rod is being inserted.

FIG. 3-C is a plane cross sectional view of the present invention after the inserting rod is inserted.

DETAILED DESCRIPTION OF THE PREFERRED EMBODIMENTS

Figure 1:
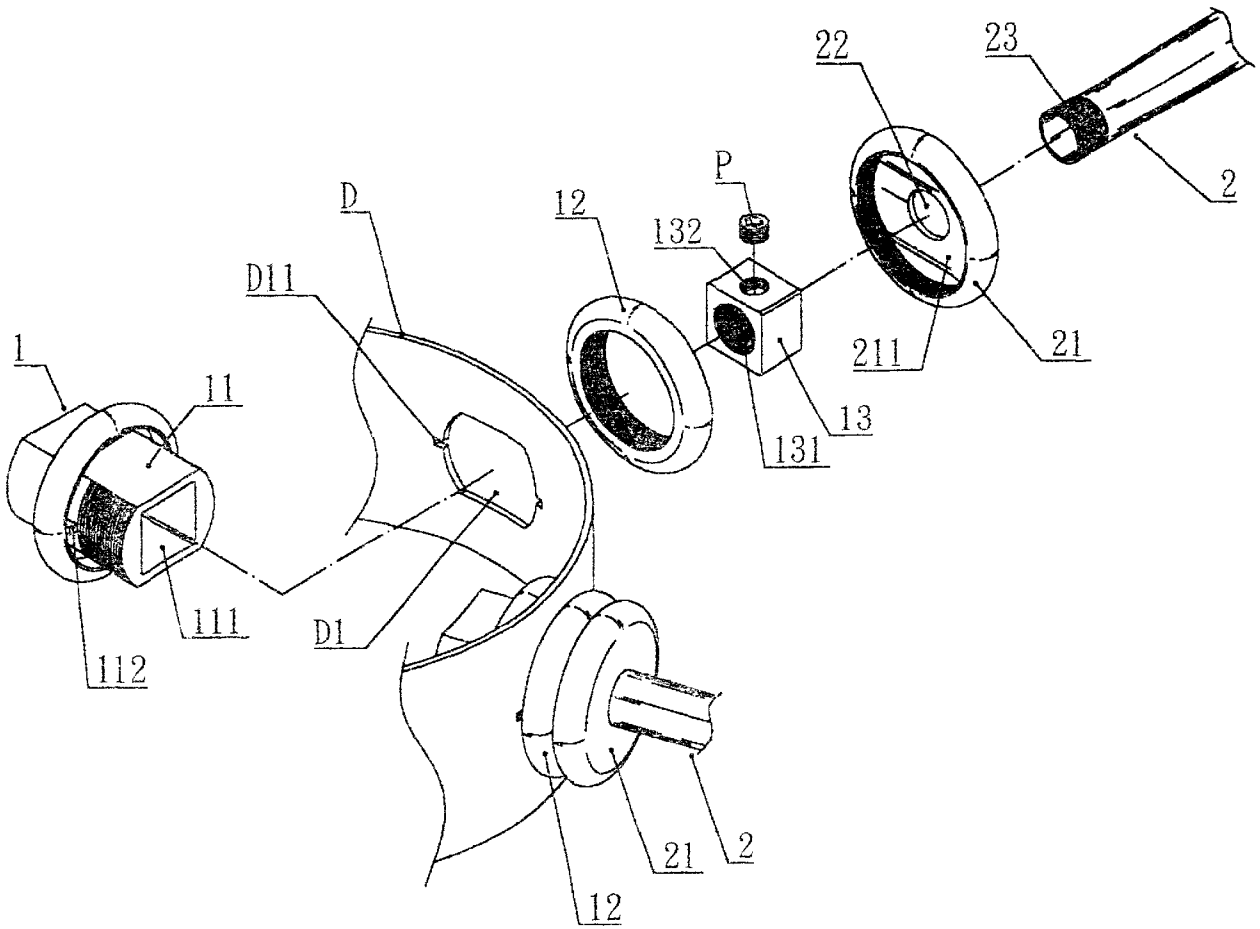
FIG. 1 is an exploded perspective view of the present invention.
Figure 2:
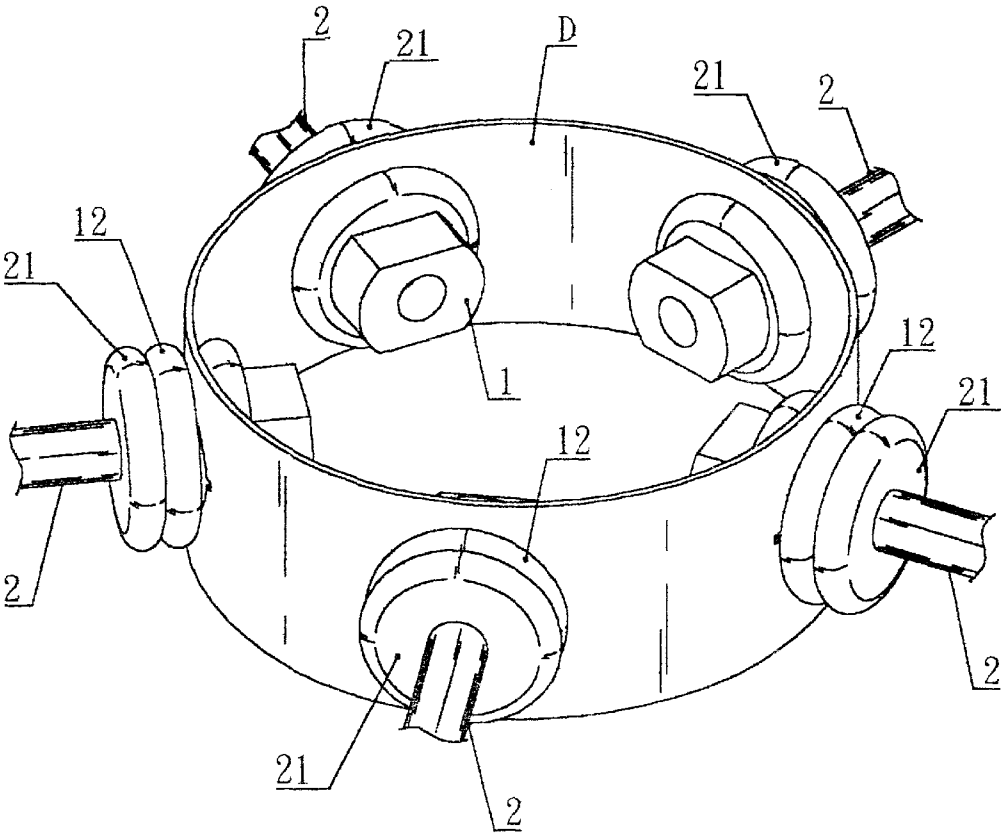
FIG. 2 is an assembled view of the present invention.

Referring to FIGS. 1 and 2, the structure of the present invention is illustrated clearly. The lamp rod of the present invention is mainly formed by a retaining seat 1 at a lateral side of a wire connecting box D, and an inserting rod 2 inserting into the retaining seat 1.

The wire connecting box D has a plurality of via holes D1 at a periphery thereof, and each of two sides of each via hole D1 has a respective buckling groove 11D.

A lateral side of the retaining seat 1 extends with an inserting portion 11 exactly passing through the via hole D1 of the wire connecting box D. Two sides of the inserting portion 11 corresponding to the buckling grooves 11D at two sides of the via hole D1 have buckling protrusions 112 for positioning the retaining seat 1. The inserting portion 11 is formed with a rectangular inserted hole 111. The portion of the inserting portion 11 passing through the inserted hole 111 is locked by a positioning ring 12 at an outer periphery thereof. Thereby, the retaining seat 1 is positioned to the inner side of the wire connecting box D. A position block 13 having a threaded hole 131 is placed in the inserted hole 111 of the retaining seat 1. Thereby, the inserting rod 2 can screw into the threaded hole 131 and the top of the positioning block 13 has a penetrating hole 132. Thus, an embedding stud P can lock into the penetrating hole 132 so that the inserting rod 2 can be limited in the positioning block 13.

The rod body of the inserting rod 2 has a limiting ring 21 with threads therein. The limiting ring 21 exactly locks into the inserting portion 11 of the retaining seat 1. The inner wall of the limiting ring 21 is protruded with an annular protrusion 22 for confining the insertion rod 2. The front section of the inserting rod 2 has an outer threaded section 23. The outer threaded section 23 is exactly locked to the threaded hole 131 of the positioning block 13. The penetrating hole 132 at a top of the positioning block 13 is screwed by the stud P. The inserting rod 2 and the positioning block 13 are locked and positioned. Then the limiting ring 21 is locked to the inserting portion 11 of the retaining seat 1 and the lateral surface 211 of the limiting ring 21 is adhered to the lateral side of the positioning block 13. Thereby, the position block 13, inserting rod 2 and retaining seat 1 are positioned to the wire connecting box D.

The assembled way of the present invention is illustrated in FIGS. 3A to 3C, at first, the inserting portion 11 of the retaining seat 1 is inserted into the via hole D1. Then at the outer side of the wire connecting box D, the positioning ring 12 is locked around the inserting portion 11 of the retaining seat 1. Thereby, the retaining seat 1 is positioned to the inner side of the wire connecting box D. Then the positioning block 13 is placed in the inserted hole 111 of the retaining seat 1 so that the inserting rod 2 can be locked into the threaded hole 131 and then the embedded stud P is utilized to lock the inserting rod 2 from the top of the retaining seat 1 and the positioning block 13, hence the inserting rod 2 is tightly engaged to the positioning block 13. Finally, the limiting ring 21 is locked to the inserting portion 11. As a result, the positioning block 13, inserting rod 2 and retaining seat 1 are positioned to the wire connecting box D.

Moreover, the inserted hole 111 in the inserting portion 11 of the wire connecting box D has a shape selected from a group containing an elliptical shape, a triangular shape, a rectangular shape, a pentagonal shape and other polygonal shape.

A limiting ring is released, then the inserting rod can be pulled out. Thus is packaged and stored, the wire connecting box and inserting rod can be detached so as to reduce the volume for storing, transferring and packaging. Since the wire connecting box and inserting rod can be detached for reducing the material for transferring and storing, and the retaining seat inserted by the inserting rod is installed to the wire connecting box in advance. Thereby, the user need only insert the inserting rod into the wire connecting box and then lock the limiting ring and thus the assembly of the present invention is completed. No other stud, or tools are necessary. Therefore, the present invention can be assembled by users.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A do-it-yourself lamp rod comprising a retaining seat at a lateral side of a wire connecting box and an inserting rod inserting into the retaining seat; wherein the wire connecting box has a plurality of via holes at a periphery thereof;

a lateral side of the retaining seat extends with an inserting portion exactly passing through one via hole of the wire connecting box; the inserting portion is formed with a polygonal inserted hole; at a portion of the inserting portion passing through the inserted hole is locked by a positioning ring at an outer periphery thereof; thereby, the retaining seat is positioned to an inner side of the wire connecting box; a positioning block having a threaded hole is placed in the inserted hole of the retaining seat; and a rod body of the inserting rod has a limiting ring with threads therein; the limiting ring is exactly locked into the inserting portion of the retaining seat; a front section of the inserting rod has an outer threaded section; the outer threaded section is exactly locked to the threaded hole of the positioning block;

wherein by assembling above components, a lamp rod is formed, which can be assembled by users and have a small volume.

2. The do-it-yourself lamp rod as claimed in claim 1, wherein each of two sides of each via hole has a respective buckling groove; and two sides of the inserting portion corresponding to the buckling grooves at the two sides of the via hole have buckling protrusions for positioning the retaining seat.

3. The do-it-yourself lamp rod as claimed in claim 1, wherein a top of the positioning block has a penetrating hole; an embedding stud is locked into the penetrating hole so that the inserting rod is limited in the positioning block.

4. The do-it-yourself lamp rod as claimed in claim 1, wherein the inserted hole in the inserting portion of the wire connecting box has a shape selected from a group containing an elliptical shape, a triangular shape, a rectangular shape, a pentagonal shape and other polygonal shape.

* * * * *